US007153414B2

(12) United States Patent
De Souza

(10) Patent No.: US 7,153,414 B2
(45) **Date of Patent: *Dec. 26, 2006**

(54) PROCESS FOR THE UPGRADING OF RAW HYDROCARBON STREAMS

(75) Inventor: Wladmir Ferraz De Souza, Rio de Janeiro (BR)

(73) Assignee: Petroleo Brasileiro S.A.-Petrobras, Rio de Janeiro (BR)

( * ) Notice: Subject to any disclaimer, the term of this patent is extended or adjusted under 35 U.S.C. 154(b) by 548 days.

This patent is subject to a terminal disclaimer.

(21) Appl. No.: 10/314,963

(22) Filed: Dec. 10, 2002

(65) Prior Publication Data

US 2004/0108252 A1 Jun. 10, 2004

(51) Int. Cl.
*C10G 17/00* (2006.01)
*C10G 29/00* (2006.01)

(52) U.S. Cl. ..... 208/208 R; 208/219; 208/222; 208/236; 208/244; 208/254; 208/254 R; 208/255; 208/256; 208/295; 208/299; 208/208

(58) Field of Classification Search ..... 208/208, 208/219, 222, 236, 244, 254, 255, 256, 295, 208/299, 208 R, 254 R
See application file for complete search history.

(56) References Cited

U.S. PATENT DOCUMENTS 2,591,946 A 4/1952 Krause
2,804,473 A 8/1957 Phillips
3,847,800 A * 11/1974 Guth et al. ..... 208/236
4,311,680 A 1/1982 Frech
4,485,007 A * 11/1984 Tam et al. ..... 208/221
5,755,977 A 5/1998 Gurol
5,910,440 A * 6/1999 Grossman et al. ..... 435/282
5,917,049 A 6/1999 Suverkropp
6,126,838 A 10/2000 Huang
6,140,294 A 10/2000 Delroisse
6,544,409 B1 * 4/2003 De Souza ..... 208/208 R

OTHER PUBLICATIONS

Chapados. Doug. et al., "Desulfurization by selective oxidation and extraction of sulfur-containing compounds to economically achieve ultra-low proposed diesel fuel sulfur requirements" NRPA Annual Meeting. Mar. 26-28, 2000.

(Continued)

*Primary Examiner*—Glenn Caldarola
*Assistant Examiner*—Prem C. Singh
(74) *Attorney, Agent, or Firm*—Sughrue Mion, PLLC

(57) ABSTRACT

A process for the upgrading of raw hydrocarbon streams rich in heteroatomic polar compounds and/or unsaturated moieties involving the extractive oxidation of sulfur, nitrogen, conjugated dienes and other unsaturated compounds from said streams, the said process comprising treating said streams with a peroxide solution/organic acid couple and an iron oxide catalyst which is a limonite ore, under an acidic pH, atmospheric pressure and ambient or higher temperature. As a result of the reaction, the oxidized heteroatomic compounds, having strong affinity for the aqueous slurry phase, are extracted into said aqueous phase, while the oxidized hydrocarbon is separated from catalyst by decanting, neutralizing, water washing and drying, the resulting end product being a hydrocarbon stream from which have been removed 90% or more of total nitrogen compounds and basic nitrogen up to 99.7%, both calculated as mass contents.

26 Claims, 6 Drawing Sheets

OTHER PUBLICATIONS

Valentine. Richard C., et al., "Iron Oxide Surface Catalyzed Oxidation of Quinoline by Hydrogen Peroxide." Journal of Env. Ironmental Engineering. Jan. 1998. vol. 124. 31-38.

Okui. Toshiaki et al., "Hydrocracking of Marlim Vacuum Residue Using Slurry Bed Reactor." Proceedings of the International Symposium on Utilization of Super-Heavy Hydrocarbon Resources. Japan Institute of Energy 2000. 21-27.

Kaneko. Takao et al., "Transformation of Iron Catalyst to the Active Phase in Coal Liquefaction" Energy & Fuels 1998. 12. 897-904.

Walling. Cheves "Fenton's Reagent Revisited" Accounts of Chemical Research vol. 8. 1975.#125-131.

Brown. K M. et al., "Low-Cost way to treat high-mercaptan gasoline." The Oil and Gas Journal, 1959. 57.#44.#73-78.

* cited by examiner $$H_2O_2 \rightleftharpoons H^+ + OOH^-$$

$$OOH^- \longrightarrow \cdot OOH + e^-$$

$$\cdot OOH \rightleftharpoons H^+ + \cdot O_2^-$$

$$H_2O_2 + \cdot OOH \longrightarrow \cdot OH + H_2O + O_2$$

$$O_2^- \longrightarrow O_2 + e-$$

$$\cdot OH + e^- \longrightarrow OH^-$$

FIG. 4

$$Fe^{2+} + H_2O_2 \longrightarrow Fe^{3+} + OH^- + {}^{\bullet}OH$$

FIG. 5

$$Fe^{3+} + H_2O_2 \longrightarrow Fe^{2+} + {}^{\bullet}OOH + H^+$$

$$H_2O_2 + {}^{\bullet}OOH \longrightarrow {}^{\bullet}OH + H_2O + O_2$$

$$Fe^{3+} + {}^{\bullet}OH \longrightarrow Fe^{2+} + OH^-$$

STATE-OF-THE-ART (USSN 09/855,947)

INVENTION

PROCESS FOR THE UPGRADING OF RAW HYDROCARBON STREAMS

FIELD OF THE INVENTION

The present invention relates to a process for the upgrading of raw hydrocarbon streams which comprises an extractive oxidation of contaminants such as heteroatomic polar compounds and/or unsaturated moieties from said streams, whereby said contaminants are oxidized in the presence of an iron oxide and an aqueous oxidant mixture of a peroxide and an organic acid and simultaneously removed from said streams by the aqueous oxidant itself, the process being exothermal and occurring in a single reactor under atmospheric pressure. More specifically, the present invention relates to a process for the removal and/or inertization of contaminants the presence of which causes odor and color instability, as well as turbidity and gums in raw hydrocarbon streams rich in said heteroatomic polar compounds and unsaturated moieties, including raw naphthas from shale oil retorting processes or other chemical processes, which enhance the polarity of said heteroatomic polar compounds. The contaminants include nitrogen, sulfur, dienes and other unsaturated compounds. The removal of total nitrogen compounds from shale oil naphtha as mass contents reaches 90% or more and basic nitrogen up to 99.7%. Conjugated dienes, which cause instability due to gums, are removed up to 22 weight % or more. Sulfur compounds, which contaminate raw naphtha, are oxidized to sulfoxides or sulfones, which are nearly odorless, and are partly removed by the aqueous oxidant mixture, leading to the removal of at least 12% of such sulfur compounds. Olefins are removed in amounts ranging of from 4% to 16 weight %.

BACKGROUND INFORMATION

Extractive oxidation used as a naphtha treating process is well-known, for example, the sweetening naphtha process, typically comprising a catalytic oxidation via $O_2$ in the presence of NaOH or KOH of odor-generating mercaptans of certain raw naphthas, more specifically those from fluid catalytic cracking. See U.S. Pat. No. 2,591,946 where is taught a sweetening process for sour oils whereby mercaptans are removed from said oils by carrying out a reaction the catalyst of which is KOH, $O_2$ and 0.004 to 0.1 wt % copper oxide based on the KOH solution.

Also, an article in the Oil and Gas Journal vol. 57 (44) p. 73–78 (1959) entitled "Low Cost Way to Treat High-Mercaptan Gasoline" by K. M. Brown et al, is directed to the discussion of the Merox process and other prior art procedures.

However, such process does not apply to raw naphthas where the target substances are those containing unsaturation and nitrogen functionalities, mainly those nitrogen functionalities of a basic character, which cause not only odor but also naphtha instabilities due to color as well as turbidity caused by gums, not to mention that those basic nitrogen substances are harmful to the hydrodesulfurization treatment processes used as naphtha finishing processes before commercialization.

The peroxide-aided oxidation is a promising path for the refining of fossil oils, and may be directed to several goals, for example to the removal of sulfur and nitrogen compounds present in fossil hydrocarbon streams, mainly those used as fuels for which the international specification as for the sulfur content becomes more and more stringent.

One further application is the withdrawal of said compounds from streams used in processes such as hydrotreatment, where the catalyst may be deactivated by the high contents in nitrogen compounds.

Basically, the peroxide oxidation converts the sulfur and nitrogen impurities into higher polarity compounds, those having a higher affinity for polar solvents relatively immiscible with the hydrocarbons contaminated by the sulfur and nitrogen compounds. This way, the treatment itself comprises an oxidation reaction step followed by a separation step of the oxidized products by polar solvent extraction and/or adsorption and/or distillation.

The oxidation reaction step using peroxides, as well as the separation steps of the oxidized compounds from the hydrocarbons have been the object of various researches.

Thus, EP 0565324A1 teaches a technique exclusively focused on the withdrawal of organic sulfur from petroleum, shale oil or coal having an oxidation reaction step with an oxidizing agent like $H_2O_2$ initially at 30° C. and then heated at 50° C. in the presence of an organic acid (for example HCOOH or AcOH) dispensing with catalysts, followed by (a) a solvent extraction step, such as N,N'-dimethylformamide, dimethylsulfoxide, N,N'-dimethylacetamide, N-methylpyrrolidone, acetonitrile, trialkylphosphates, methyl alcohol, nitromethane among others; or by (b) an adsorption step with alumina or silica gel, or (c) a distillation step where the improved separation yields are caused by the increase in boiling point of the sulfur oxidized compounds.

A similar treatment concept is used by D. Chapados et al in "Desulfurization by Selective Oxidation and Extraction of Sulfur-Containing Compounds to Economically Achieve Ultra-Low Proposed Diesel Fuel Sulfur Requirements", NPRA 2000 Annual Meeting, Mar. 26–28, 2000, San Antonio, Tex., Paper AM-00-25 directed to a refining process also focused on the reduction of the sulfur content in oils, the oxidation step occurring at temperatures below 100° C. and atmospheric pressures, followed by a polar solvent extraction step and by an adsorption step. The authors further suggest the use of a solvent recovery unit and another one for the biological treatment of the concentrate (extracted oxidized products) from the solvent recovery unit, this unit converting said extracted oxidized products into hydrocarbons.

According to the cited reference by Chapados et al., the reaction phase consists of an oxidation where a polarized —O—OH moiety of a peracid intermediate formed from the reaction of hydrogen peroxide and an organic acid performs an electrophilic oxidation of the sulfur compounds, basically sulfides such as benzothiophenes and dibenzothiophenes and their alkyl-related compounds so as to produce sulfoxides and sulfones.

U.S. Pat. No. 3,847,800 teaches that the oxidation of the nitrogen compounds, such as the quinolines and their alkyl-related compounds so as to produce N-oxides (or nitrones) can be promoted as well when reacting these compounds with a nitrogen oxide.

The mechanisms for the oxidation of sulfur containing compounds with a peracid derived from a peroxide/organic acid couple are shown in FIG. 1 attached, with dibenzothiophene taken as model compound.

According to U.S. Pat. No. 2,804,473, the oxidation of amines with an organic peracid leads to N-oxides, therefore a reaction pathway analogous to that of sulfur-containing compound is expected for the oxidation of nitrogen-containing compounds with a peracid derived from the peroxide/organic acid couple, as shown in FIG. 2 attached, with quinoline taken as model compound. In addition, the same US patent teaches a process for the production of lower aliphatic peracids. According to this publication, peracids are useful in a variety of reactions, such as oxidation of unsaturated compounds to the corresponding alkylene oxide derivatives or epoxy compounds.

As illustrated in FIG. 3 attached, it is also well-known that hydrogen peroxide naturally decomposes into unstable intermediates that yield $O_2$ and $H_2O$, such process being accelerated by the action of light, heat and mainly by the pH of the medium.

U.S. Pat. No. 5,917,049 teaches a process for preparing dicarboxylic acids containing at least one nitrogen atom where the corresponding heterocyclic compound of fused benzene ring bearing at least one nitrogen atom is oxidized in the presence of hydrogen peroxide, a Bronsted acid and an iron compound. The preferred iron compound is iron nitrate and nitric acid is used as the Bronsted acid. The reaction occurs in an aqueous medium.

Besides, U.S. Pat. No. 4,311,680 teaches a process for removal of sulfur containing compounds such as $H_2S$, mercaptans and disulfides from gas streams exclusively such as natural gas by flowing the said gas stream through a $Fe_2O_3$ fixed bed in presence of an aqueous solution of hydrogen peroxide.

On the other hand, several publications report the use of the Fenton's reagent exclusively directed for the withdrawal of pollutants from aqueous municipal and industrial effluents. See the article by C. Walling, "Fenton's Reagent Revisited", Accts. Chem. Res., Vol. 8, p. 125–131 (1975), U.S. Pat. No. 6,126,838 and U.S. Pat. No. 6,140,294 among others.

Fenton's reagent, known since 1894, is traditionally a mixture of $H_2O_2$ and ferrous ions exclusively in an aqueous medium, so as to generate the hydroxyl radical OH as illustrated in FIG. 4 attached. The hydroxyl radical is one of the most reactive species known. Its Relative Oxidation Power (ROP) ROP=2.06 (relative to $Cl_2$ whose ROP=1.0), is higher than that for example of singlet oxygen (ROP=1.78)>$H_2O_2$(ROP=1.31)>HOO(ROP=1.25)>permanganate(ROP=1.24), this making it able to react with countless compounds.

However, side reactions consume or compete with the hydroxyl radical due to the presence of $Fe^{3+}$ or due to the natural dissociation of the hydrogen peroxide, as illustrated in FIG. 5 attached.

Such side reactions may be minimized by reducing the pH in the medium, since the protic acidity reverts the dissociation equilibrium of the $H_2O_2$ into $H^+$ and $OOH^-$ (as per FIG. 3 attached), so as to prevent the transformation of the generated OOH— into HOO which will lead more $H_2O_2$ to $H_2O$ and $O_2$ in spite of the co-generation of the desired hydroxyl radical. On the other hand, excessive lowering of pH leads to the precipitation of $Fe(OH)_3$ that catalyses the decomposition of $H_2O_2$ to $O_2$.

Thus, it is recommended to work at pH 2.0–6.0, while afterwards adjusting the reaction pH until 6.1–9.0 to allow for a better separation of the products by flocculation of the residual ferrous sulfate salts, when this salt is the source of ferrous cations of the conventional Fenton's reagent.

However, in case of any free ferric cations are produced and consume or inhibit the generation of the hydroxyl radical (as per FIG. 5), those could be scavenged by complexing agents (as for example phosphates, carbonates, EDTA, formaldehyde, citric acid) only if those agents would not at the same time scavenge the ferrous cations also solved in aqueous media and required for the oxidation reaction.

Sources of active Fe attached to a solid matrix known as useful for generating hydroxyl radicals are the crystals of iron oxyhydrates FeOOH such as Goethite, used for the oxidation of hexachlorobenzene found as a pollutant of soil water resources.

R. L. Valentine and H. C. A. Wang, in "Iron oxide Surface Catalyzed Oxidation of Quinoline by Hydrogen Peroxide", Journal of Environmental Engineering, 124(1), 31–38 (1998), relate a procedure to be used exclusively on aqueous effluents using aqueous suspensions of ferrous oxides such as ferrihydrite, a semicrystalline iron oxide and goethite, both being previously synthesized, to catalyze the hydrogen peroxide oxidation of a model water polluting agent, quinoline, present in concentrations of nearly 10 mg/liter in an aqueous solution the characteristics of which mime a natural water environment. Among the iron oxides used by the authors, a suspension of crystalline goethite containing a complexing agent (for example carbonates) produced higher quinoline abatement from the aqueous solution, after 41 hours reaction. According to the author, the complexing agent is adsorbed on the catalyst surface so as to regulate the decomposition of $H_2O_2$. The article does not mention the formed products and the Goethite employed was a pure crystalline material synthesized by aging $Fe(OH)_3$ at 70° C. and pH=12 during 60 h.

Pure goethite such as the one utilized by Valentine et al. is hardly found in free occurrences in the nature; however, it can exist as a component of certain natural ores.

U.S. Pat. No. 5,755,977 teaches a process where a contaminated fluid such as water or a gas stream containing at least one contaminant is contacted in a continuous process with a particulate goethite catalyst in a reactor in the presence of hydrogen peroxide or ozone or both to decompose the organic contaminants. It is mentioned that the particulate goethite may also be used as a natural ore form. However, the particulate goethite material actually used by the author in the Examples was a purified form purchased from commercial sources, and not the raw natural ore.

Goethite is found in nature in the so-called limonite and/or saprolite mineral clays, occurring in laterites (natural occurrences which were subjected to non-eroded weathering, i.e. by rain), such as in lateritic nickel deposits, especially those layers close by the ones enriched in nickel ores (from 5 to 10 m from the surface). Such clays constitute the so-called limonite zone (or simply limonite), where the strong natural dissolution of Si and Mg leads to high Al, Ni concentrations (0.8–1.5 weight %), also Cr and mainly Fe (40–60 weight %) as the hydrated form of FeOOH, that is, $FeOOH._{n}H_2O$.

The layers below the limonite zone show larger amounts of lateritic nickel and lower amounts of iron as Goethite crystals. This is the so-called saprolite zone or serpentine transition zone (25–40 weight % Fe and 1.5–1.8 weight % Ni), immediately followed by the garnierite zone (10–25 weight % Fe and 1.8–3.5 weight % Ni) that is the main source of garnierite, a raw nickel ore for industrial use.

The open literature further teaches that the crystalline iron oxyhydroxide FeOOH may assume several crystallization patterns that may be obtained as pure crystals by synthetic processes. Such patterns are: α-FeOOH (Goethite cited above), γ-FeOOH (Lepidocrocite), β-FeOOH (Akaganeite), or still δ'-FeOOH (Ferroxyhite), this latter having also magnetic properties. The most common crystallization patterns are Goethite and Lepidocrocite.

The iron oxyhydroxide crystalline form predominant in limonite is α-FeOOH, known as Goethite. The Goethite (α-FeOOH) crystallizes in non-connected layers, those being made up of a set of double polymeric ordered chains. This is different, for example, from the synthetic form Lepidocrocite (γ-FeOOH), which shows the same double ordered chain set with interconnected chains. This structural difference renders the α-FeOOH more prone to cause migration of free species among the non-connected layers.

Limonite contains iron at 40–60 weight % besides lower contents of nickel, chrome, cobalt, calcium magnesium, aluminum and silicon oxides, depending on the site of occurrence.

The specific area of limonite is 40–50 $m^2/g$, besides being a low cost mineral, of easy pulverization and handling; its dispersion characteristics in hydrophobic mixtures of fossil hydrocarbons are excellent.

Limonite was found to be easily dispersed in fossil oils as a precursor of pyrrothite ($Fe_{1-x}S$), as reported by T. Kaneko et al in "Transformation of Iron Catalyst to the Active Phase in Coal Liquefaction", Energy and Fuels 1998, 12, 897–904 and T. Okui et al, in "Proceedings of the Intl. Symposium on the Utilization of Super-Heavy Hydrocarbon Resources (AIST-NEDO)", Tokyo, Sept. 2000.

This behavior is different from that of a Fe(II) salt such as ferrous sulfate or ferrous nitrate, that requires an aqueous medium to effect the formation of Fenton's reagent.

Thus, the present invention makes use of the oil dispersion character of pulverized limonite ore in order to perform the direct Fenton-type oxidation of sulfur, nitrogen, conjugated dienes and other unsaturated compounds present in naphtha streams, in addition to the classical oxidation worked by peracids alone.

U.S. Ser. No. 09/855,947 of May 15, 2001 of the Applicant and fully incorporated herein as reference, teaches the catalytic oxidation of organic compounds in a hydrophobic, fossil oil medium in the presence of a peracid (or peroxide/acid couple), the oxidation reaction being catalyzed by an iron oxide such as a pulverized limonite ore working as a highly-dispersible source of catalytically active iron in this oil medium.

Thus, the literature mentions processes for the treatment of organic compounds from fossil oils through oxidation in the presence of peracids (or peroxides and organic acids), as well as treating processes of aqueous or gaseous media using the Fenton's reagent. U.S. Ser. No. 09/855,947 of May 15, 2001 is directed to the catalytic oxidation of organic compounds in a hydrophobic, fossil oil medium in the presence of a peracid (or peroxide/acid couple), the oxidation reaction being catalyzed by an iron oxide such as a pulverized limonite ore working as a highly dispersible source of catalytically active iron in this oil medium. However, there is no description nor suggestion in the literature of an extractive oxidation of heteroatomic polar compounds, conjugated dienes and other unsaturated moieties from raw hydrocarbon streams, whereby such compounds are oxidized in the presence of an aqueous slurry of a peroxide solution/organic acid couple and an iron oxide ore and simultaneously removed from said streams by the oxidant itself, said process being described and claimed in the present invention.

SUMMARY OF THE INVENTION

Broadly, the present invention relates to a process for the extractive oxidation of sulfur, nitrogen, conjugated dienes and other unsaturated compounds present in high amounts in raw hydrocarbon streams rich in heteroatomic polar compounds from fossil oils or from fossil fuel processing which enhances the polarity of said heteroatomic compounds, said oxidation and simultaneous aqueous extraction of the resulting oxidized compounds being effected in the presence of peroxide/organic acids and a catalyst which is a raw iron oxide such as the limonite clays, used in the natural state.

The invention is directed to the simultaneous oxidation and removal and/or inertization of the sulfur, nitrogen, conjugated dienes and other unsaturated compounds from said naphtha streams.

The process of the invention for the oxidation and/or inertization of sulfur, nitrogen, conjugated dienes and other unsaturated compounds from raw hydrocarbon streams rich in heteroatomic polar compounds in the presence of a peroxide solution/organic acid couple and a pulverized raw iron oxide catalyst at atmospheric pressure and equal or higher than ambient temperature comprises the following steps:

a) Oxidizing sulfur, nitrogen, conjugated dienes and unsaturated compounds present in said raw hydrocarbon streams by admixing, under agitation, said organic acid and said peroxide, the weight percent of the peroxide solution and organic acid based on raw naphtha being at least 3 and 4 respectively and then adding said raw hydrocarbon stream containing sulfur, nitrogen, conjugated dienes and unsaturated compounds and then the raw iron oxide pulverized and dried catalyst, at a pH between 1.0 and 6.0, in an amount of from 0.01 to 5.0 weight % based on the weight of raw hydrocarbon, the reaction being carried out under reflux of vaporized hydrocarbon, for the period of time required to effect the extractive oxidation and obtaining a hydrocarbon stream wherefrom the sulfur, nitrogen, conjugated dienes and unsaturated compounds have been partially oxidized and simultaneously extracted by the oxidant slurry, yielding a lower aqueous slurry phase and an upper oxidized hydrocarbon phase;

b) After the end of said extractive oxidation, separating the upper hydrocarbon phase, neutralizing and water washing same, filtering and drying so as to obtain a treated, odorless, clear yellowish and stable hydrocarbon phase;

c) Recovering said treated, odorless, clear yellowish and stable hydrocarbon phase wherefrom the total nitrogen compounds have been removed up to 90% by weight or more, basic nitrogen compounds have been removed up to 99.7% by weight, conjugated diene compounds have been removed up to 22% by weight or more, and sulfur compounds have been removed up to 13% by weight, followed by olefin removal ranging from 4% to 16 weight %, all percentages being based on the original feedstock content.

Alternatively, the pulverized and dried raw iron oxide catalyst is added in the first place to the hydrocarbon stream containing sulfur, nitrogen and conjugated diene and other unsaturated compounds.

Thus the present invention provides a process for the extractive oxidation and/or inertization of sulfur, nitrogen, conjugated diene and other unsaturated compounds from hydrocarbon streams through oxidation with peroxide/organic acid couple, the oxidation being aided by a raw, pulverized and dried iron oxide ore such as limonite.

The present invention provides also a process for the simultaneous oxidation and removal (and/or inertization) of sulfur, nitrogen, conjugated dienes and other unsaturated compounds from raw hydrocarbon streams through oxidation with peroxides and organic acids, the oxidation being aided by a source of active fixed iron generated in situ from a pulverized raw iron oxide ore such as limonite.

The present invention provides further a process for the extractive oxidation and/or inertization of sulfur, nitrogen, conjugated diene and other unsaturated compounds from raw hydrocarbon streams where the improved oxidation in the presence of limonite catalyst yields oxidized compounds that have more affinity for an aqueous phase such as the oxidant slurry than they have for the hydrocarbon phase.

The present invention provides further a process for the extractive oxidation and/or inertization of sulfur, nitrogen, conjugated diene and other unsaturated compounds from raw hydrocarbon streams where the dispersion character of the pulverized limonite catalyst in the hydrocarbon stream aids in improving the oxidation of said streams.

The present invention provides still an extractive oxidation and/or inertization process for obtaining treated hydrocarbon streams suitable as feedstock for further refining processes such as hydrotreatment or catalytic cracking, since most of the catalysts harmful compounds have been removed.

The present invention provides further an extractive oxidation and/or inertization process for obtaining, from a hydrocarbon stream such as a raw naphtha contaminated with up to 0.1 weight % of basic N, 0.2 weight % total N and 1.0 weight % total S, up to 3.0 mole/L of conjugated dienes, treated naphtha streams having basic nitrogen contents less than 5 ppm, total nitrogen contents less than 250 ppm and conjugated dienes less than 1.90 mole/L.

BRIEF DESCRIPTION OF THE DRAWINGS

FIG. 4 attached illustrates the composition of Fenton's reagent, a mixture of $H_2O_2$ and ferrous ions so as to generate the hydroxyl radical.

FIG. 5 attached illustrates the mechanism of side reactions that consume or compete with the formation of the hydroxyl radical.

DETAILED DESCRIPTION OF THE INVENTION

According to the invention, the expression "raw hydrocarbon" or "raw naphtha" means any hydrocarbon or naphtha stream rich in heteroatomic polar compounds and/or unsaturated moieties, which has not been submitted to any treatment, such as Merox, hydrotreatment or caustic washing process.

The present invention is based on the principle of the oxidation via free radicals, more specifically, free hydroxyl radicals generated by the catalytic action of a raw iron ore, more specifically limonite, on a mixture of a peroxide solution and an organic acid, the oxidation being alternatively combined to the principle of oxidation via the action of an in situ formed peracid from the same peroxide and the same acid. These combined principles are thoroughly described in our previous application U.S. Ser. No. 09/855,947 of May 15, 2001. As described therein, nitrogen, sulfur and unsaturated contaminating substances present in fossil oils, when oxidized through the application of the said principles, are converted into sulfones, sulfoxides, nitrones and alcohols of sufficiently high polarity to acquire an increased affinity for certain organic solvents and adsorbents. That is why the separation of the resulting oxidized products is carried out with the aid of said solvents and adsorbents.

Figure 8:
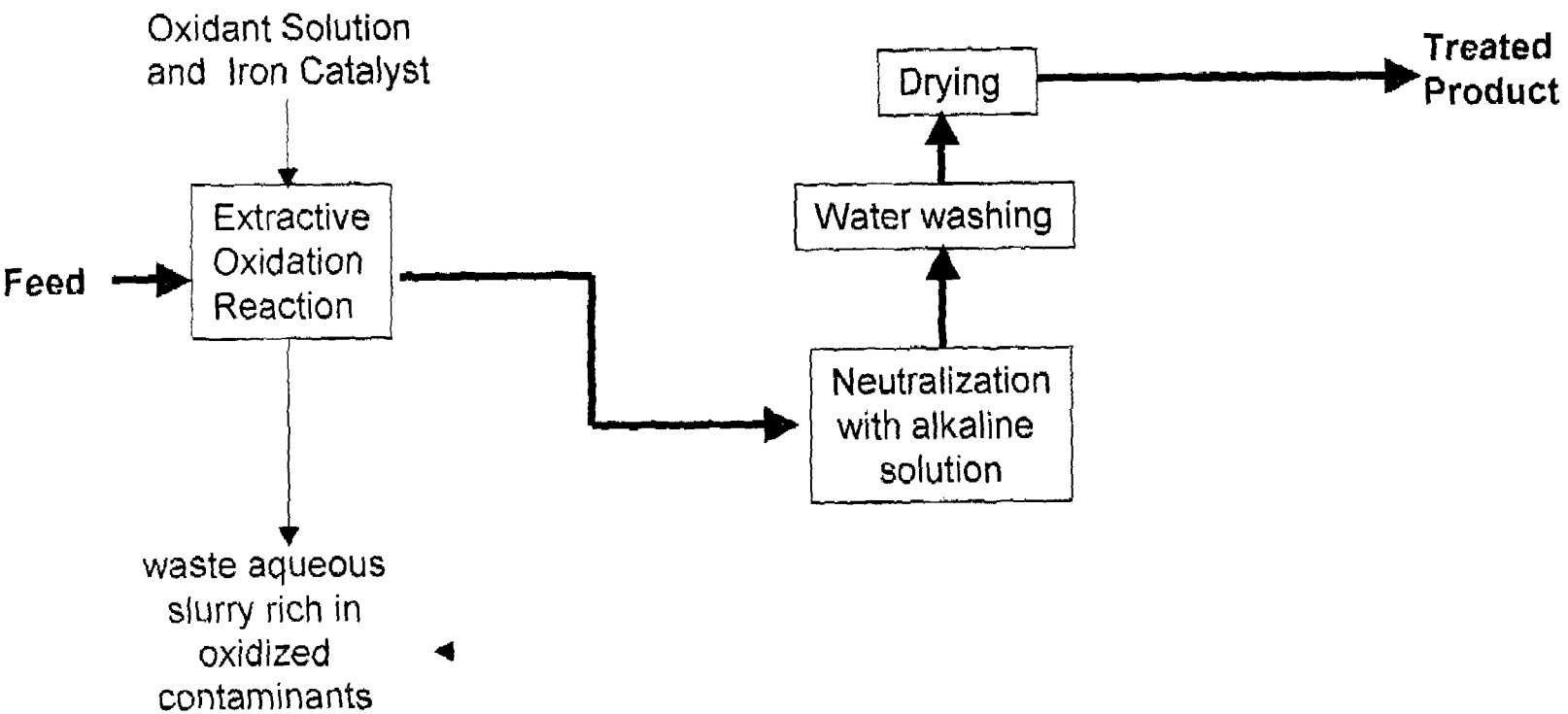
FIG. 8 attached is a schematic flowchart of the process of the present invention as compared to the state-of-the-art flowchart of U.S. Ser. No. 09/855,947.

In the specific case of the present extractive oxidation process directed to raw hydrocarbons such as raw naphtha cuts from refining processes such as shale oil retorting, the contaminating substances oxidized through the use of such principles show a marked affinity for the oxidizing aqueous slurry itself. This is why such oxidized compounds are easily and quickly extracted from the reaction medium. This behavior is illustrated in FIG. 8.

Figure 7:
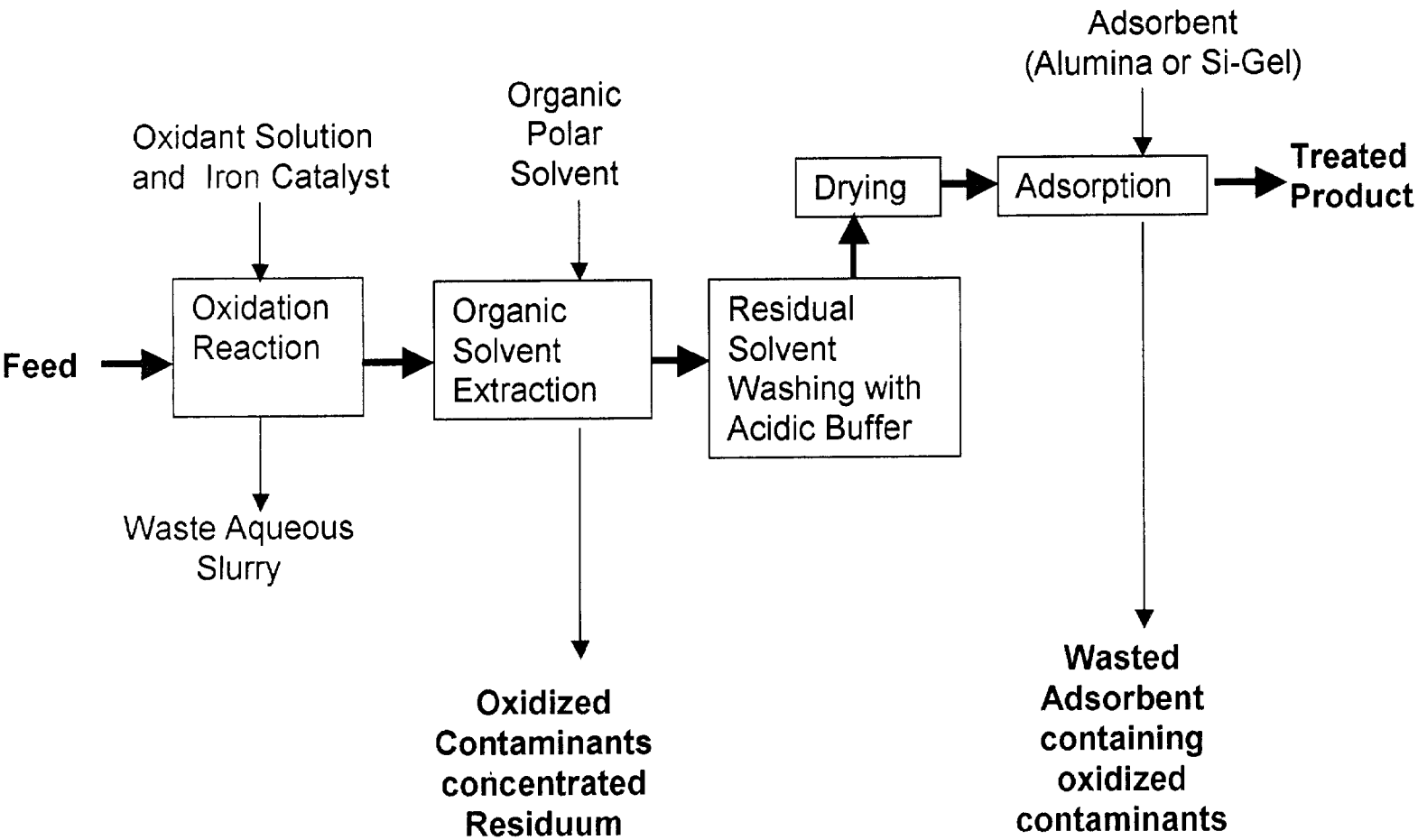
FIG. 7 attached is a schematic flowchart of the state-of-the-art process of U.S. Ser. No. 09/855,947 of May 15, 2001.

On the other hand, according to FIG. 7, in the case of the fossil oil fraction oxidation of U.S. Ser. No. 09/855,947, the oxidized contaminants present in the hydrocarbon reaction medium do not have sufficient affinity for the aqueous oxidant slurry, requiring therefore the use of a strongly polar organic solvent and/or proper adsorbents to accomplish separation of said contaminants.

Therefore, the improvement brought about by the present invention relative to said U.S. Ser. No. 09/855,947 allows to dispense with operationally expensive steps such as the organic solvent extraction itself, including solvent regeneration and/or adsorption including adsorbent regeneration. Such steps usually cause a low overall process yield due to the several material losses throughout the process. In view of the cheaper and operationally easier steps of the present process, higher product yields are obtained.

In order to make easier the understanding of the principles of the present invention, the following paragraphs state the theoretical principles as well as laboratory implementation of same in a didactic manner.

Feedstock

The present process of extractive oxidation is useful for any raw hydrocarbon feed rich in heteroatomic polar compounds and/or unsaturated moieties from refining processes, including any raw light and middle distillates.

One particular useful feedstock is raw naphtha obtained from shale oil retorting or other refining processes. Useful naphtha streams for the present process do not need to have been hydrotreated or sweetened. The boiling point range of these naphtha products is of from 30° C. to 300° C. Preferably the boiling range is of from 35° C. to 240° C. Sulfur contents extend up to 15,000 ppm, preferably of from around 7,000 to 9,000 ppm. Basic nitrogen contents extend up to 2,000 ppm. Total nitrogen contents extend up to 3,000 ppm. Olefin contents, more specifically open-chain or cyclic olefin compounds, for example, monoolefins, diolefins or polyolefins extend of from 10 to 40 weight %. Total aromatics contents extend of from 40 to 90 weight %. Conjugated dienes contents extend up to 3 mole/L.

Catalyst

The extractive oxidation process herein presented occurs by the combination of peroxide and an organic acid, the oxidation being activated by a dried, pulverized raw Fe oxide catalyst.

The iron oxide catalyst is limonite ores mostly made up of iron oxyhydroxide. For the purposes of the invention, the limonite ore is used in the natural state, only pulverized until a granulometry lower than 0.71 mm (25 mesh Tyler), preferably lower than 0.177 mm (80 mesh Tyler), and dried.

Crystalline, semi-crystalline and amorphous forms of iron oxide compounds may be used. Useful iron oxides are those iron oxyhydroxides mentioned hereinbefore, such as α-FeOOH (Goethite), γ-FeOOH (Lepidocrocite), β-FeOOH (Akaganeite), or still δ'-FeOOH (Ferroxyhite), this latter having also magnetic properties. A preferred form of iron oxyhydroxide is limonite clay.

The iron catalyst may be prepared by pulverizing, kneading, and granulating the above cited oxides, the iron being in the form of hydroxide, oxide or carbonate, alone or admixed with inorganic materials such as alumina, silica, magnesia, calcium hydroxide, manganese oxide and the like.

Limonite clays are abundant in numerous natural occurrences around the world, for instance, Brazil, Australia, Indonesia, Venezuela and other countries. In some cases limonite is a waste product from nickel mining activities and therefore a low-cost material.

The limonite surface area is 40–50 $m^2/g$. The iron content of limonite is around 40–60 weight %.

It should be understood that pulverized limonite has a strong affinity for the hydrocarbon phase; it is wetted by same and interacts with peroxides (hydrogen peroxide and peroxyacids), which are usually present in an aqueous phase. Therefore, without willing to be specially bound to any particular theory, it is hypothesized that the goethite surface present in pulverized limonite carries those peroxides to the oil phase. At the same time those peroxides cause fixed Fe sites to be activated from Fe (III) to Fe (II), which catalyzes the formation of the hydroxyl radical.

The catalytic amount of limonite to be used in the present process may vary within rather large limits, for example of from 0.01 to 5.0 weight %, and more preferably of from 0.5 to 3.0 weight % based on the weight of raw naphtha submitted to the process.

The peroxide useful in the practice of the invention may be inorganic or organic.

Analogously to the peroxide, ozone may be used as well, alone or in admixture with the peroxide(s).

Preferably the inorganic peroxide is a hydroperoxide that may be the hydrogen peroxide $H_2O_2$.

Hydrogen peroxide is preferably employed as an aqueous solution of from 10% to 70% by weight $H_2O_2$ based on the weight of the aqueous hydrogen peroxide solution, more preferably containing of from 30% to 70% by weight $H_2O_2$.

The organic peroxide can be an acyl hydroperoxide of formula ROOH, where R=alkyl, $H_{n+2}C_nC(=O)$— (n>=1), Aryl-C (=O)—, HC(=O)—.

The organic acid is preferably a carboxylic acid RCOOH or its dehydrated anhydride form RC(=O)OC(=O)R, where R can be H, or $C_nH_{n+2}$ (n>=1) or $X_mCH_{3-m}COOH$ (m=1~3, X=F, Cl, Br), polycarboxylic acid —[R(COOH)—R(COOH)]$_{x-1}$— where (x>=2), or still a benzoic acid, or mixtures of same in any amount.

One preferred carboxylic acid is formic acid. Usually, formic acid is employed at a concentration ranging of from 85% to 100 weight %. The preferred formic acid is an analytical grade product, having concentration between 98–100 weight %.

Another preferred carboxylic acid is acetic acid. Usually, acetic acid is employed at a concentration ranging from 90% to 100 weight %.

The weight percent of the peroxide solution and organic acid based on raw hydrocarbon is at least 3 and 4 respectively. More preferably, the weight percent of the peroxide solution and organic acid is of from 6 to 15 and of from 8 to 20, respectively. Higher weights percent depend on economic feasibility.

In view of the presence of acid in the reaction medium the pH of the medium is generally acid, varying from 1.0 to 6.0, preferably 3.0.

The useful peroxide/organic acid molar ratio shall range from 0.5 to 1.2, preferably 0.9 to 1.1, or still preferably 0.95 to 1.

After the oxidation the medium is neutralized at a pH 6.1–9.0 with the aid of a saturated $Na_2CO_3$ solution or of any other alkaline salt solution.

The iron component, as found throughout the particle surfaces of finely pulverized limonite is adequate for the reaction with a peroxide such as $H_2O_2$ in contact with an oil phase in order to generate the hydroxyl radical, active to oxidize organic compounds such as unsaturated compounds as well as nitrogen and sulfur contaminants present in said oil phase.

The generated hydroxyl radical is a powerful oxidant and its oxidative activity is associated to the ionic oxidative activity of the organic peracid, substantially improving the oxidation of fossil oils and related products. As will be shown later in the present specification by means of a comparative Example, the produced oxidized compounds show stronger affinity for polar solvents than in the case the oils were treated with the peroxide-organic acid couple alone.

Thus the process of the invention involves fundamentally an oxidation step at ambient temperature that combines in a synergistic way two reaction mechanisms: (1) one via active free radicals, produced by the reaction of one peroxide of a peroxide/organic acid couple with the surface of the crystals of the iron oxide combined to (2) an oxidation via the action of a peracid intermediate generated by the reaction of the peroxide with an organic acid.

As will be seen later in the present specification, researches conducted by the Applicant have led to the conclusion that such two combined oxidation mechanisms yield an end product of lower contents in total sulfur, nitrogen and unsaturated compounds mainly basic nitrogen compounds.

The extent of removal of nitrogen and sulfur compounds is strongly dependent on the combination of the peroxide, organic acid and limonite amounts, for instance, larger molar ratios of peroxide and organic acid lead to more pronounced removal of those contaminants. In addition, the larger peroxide molar ratio favors the removal of unsaturated compounds to some extent. Thus the present invention relates to a flexible process, easily adaptable to the contaminating conditions of the raw hydrocarbon feedstock to be treated.

One-pot Reaction and Extraction

The extractive oxidation of the invention is a one-pot system. The produced oxidized compounds are extracted from the hydrocarbon medium by the aqueous phase as soon as formed, since the affinity of the aqueous phase and those compounds is enhanced upon oxidation.

As for the order of addition of the oxidizing compounds contemplated in the practice of the invention to the oxidizing and removal of S- and N-compounds from a raw hydrocarbon medium, the concept of the invention contemplates two main modes.

The previously admixed peroxide/organic acid couple is added to a mixture of raw hydrocarbon feedstock as defined above with the catalyst, which is a pulverized and dried iron oxide ore, preferably limonite ore.

Alternatively, the hydrocarbon feedstock is added over the peroxide/organic acid couple, previously admixed and then receive the addition of the iron catalyst.

As for the reaction conditions, pressure is atmospheric, while temperature extends from the ambient at the reaction start until a final temperature which ranges from 60° C. to 80° C. by self-heating the duration of which is approximately 10 min to 30 minutes. After that, the reaction system is cooled until the end of total reaction time, which ranges from 1 hour to 1.5 hours.

The overall reaction is effected under stirring. Stirring should be strong enough to keep suspended the aqueous slurry.

The reaction is carried out under reflux of vaporized hydrocarbon, the vaporization being due to the reaction self-heating. The reflux is cooled by a fluid such ethyl alcohol or acetone as cold as −5° C. The mechanisms of hydroxyl free radical formation lead to the generation of free $O_2$, which can be controlled by the catalyst amount. On the other hand, $O_2$ generation yields a certain amount of foam within the reaction medium, which enhances the transfer of active species throughout immiscible phases.

The free radical generation reactions, as well as the oxidation of unsaturated compound reaction, are exothermal, making possible to provide energy to other parallel, endothermic reactions. The total heat evolution provides a temperature profile that starts at room temperature and extends up to 70° C. within a time interval of from 10 to 30 minutes, followed by a certain stationary period at that maximum temperature, and after that, decreasing until room temperature. Alternatively, the temperature profile may start at a higher than room temperature, for example, of from 35° C.–45° C., obtained by external heating, and followed by the same self heating behavior stated before.

The reactants are a three-phase mixture, made up of a hydrocarbon phase comprising treated hydrocarbon, an aqueous phase comprising spent oxidant and a solid phase, comprising the iron oxide catalyst.

After the reaction completion, this mixture is cooled to ambient temperature and decanted to separate an aqueous slurry phase from the hydrocarbon phase. The aqueous slurry phase comprises the spent oxidant solution and the iron oxide catalyst mostly reusable in further reactions.

The hydrocarbon phase, the pH of which is usually in the range of 3–4, is neutralized to eliminate residual acidity remaining from the reaction medium. Preferred neutralizing agents are salt alkaline solutions, such as a $Na_2CO_3$, or $Na_2SO_3$ solution. The pH of the neutralized hydrocarbon is in the range of 5–6, slightly less than neutral in order to avoid residual basicity from the alkaline solution, which may cause analytical misinterpretations during determination of basic nitrogen content, even if the neutralized hydrocarbon is additionally washed with distilled water to remove any residual salts.

The neutralized and washed hydrocarbon is then filtered and dried with the aid of any well-known drying procedure or means. For the sake of convenience the waste water and waste alkaline neutralizing solutions may be recycled after being partially purged.

The aqueous slurry phase, comprising the spent oxidant solution and iron oxide catalyst, is decanted to separate the solid catalyst phase, which may be either disposed off or reused after being washed and dried. In case it is reused, a small portion of the solid catalyst is purged and made up with fresh limonite in order to replace spent catalyst, since deposition of oxidized material takes place over catalyst surface as well as the catalyst is rendered inactive by the conversion of goethite into maghemite and hematite, inactive matter being limited to ca. 2% according to X-ray measurements.

Analogously, the upper aqueous solution mostly comprising organic acid may be either disposed off or reused. In the latter case, a small portion of this aqueous solution is purged and made up with fresh organic acid prior to reuse. This upper aqueous solution contains most of the oxidized and extracted material from the hydrocarbon, therefore the purged and make-up portions should be designed accordingly.

The purged liquid portions may be considered as a part of refinery acidic waste water disposal.

Figure 1:
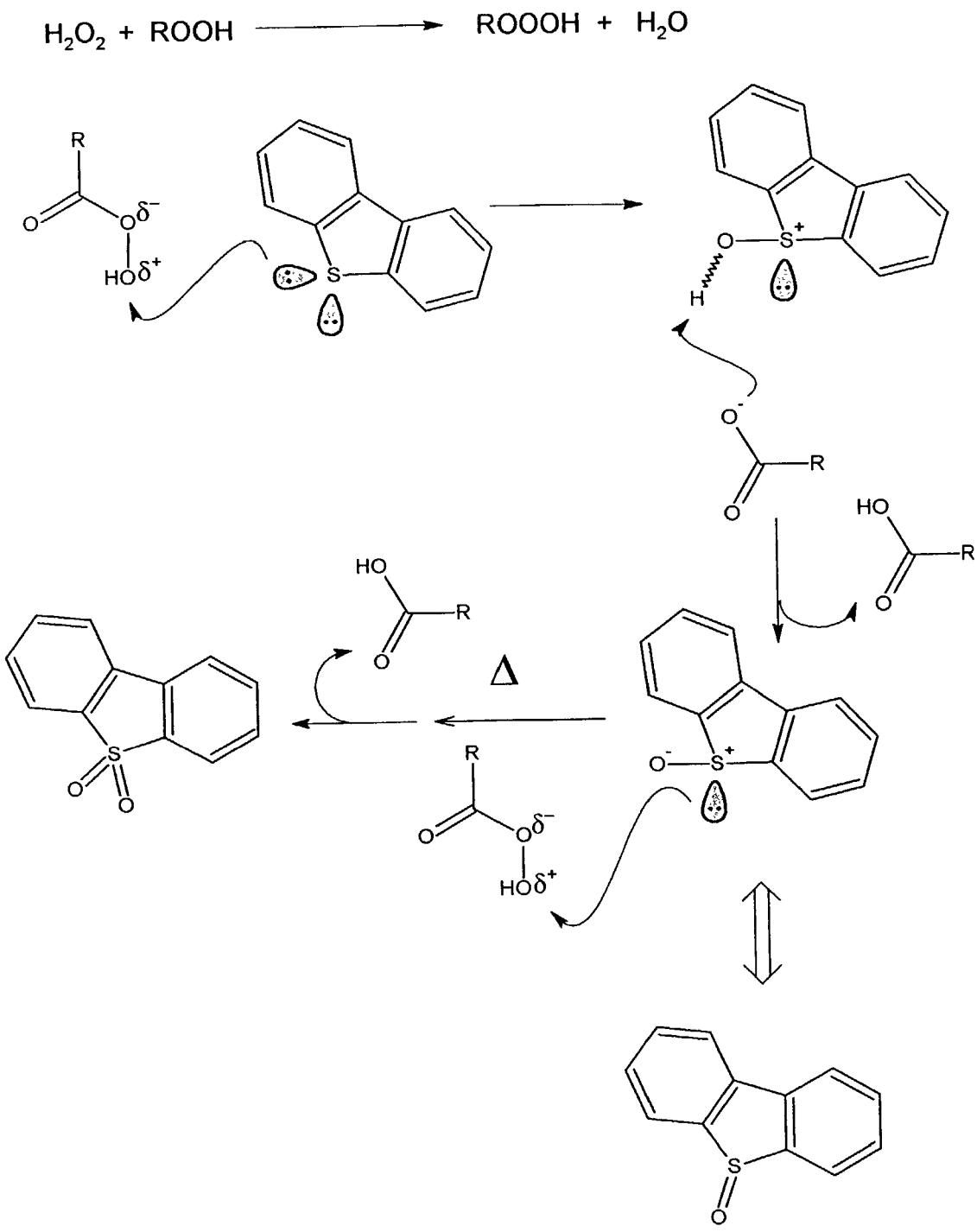
FIG. 1 attached illustrates the oxidation mechanism of a model sulfur compound such as dibenzothiophene that generates sulfoxides and sulfones, in the presence of hydrogen peroxide and an organic acid.
Figures 2, 3:
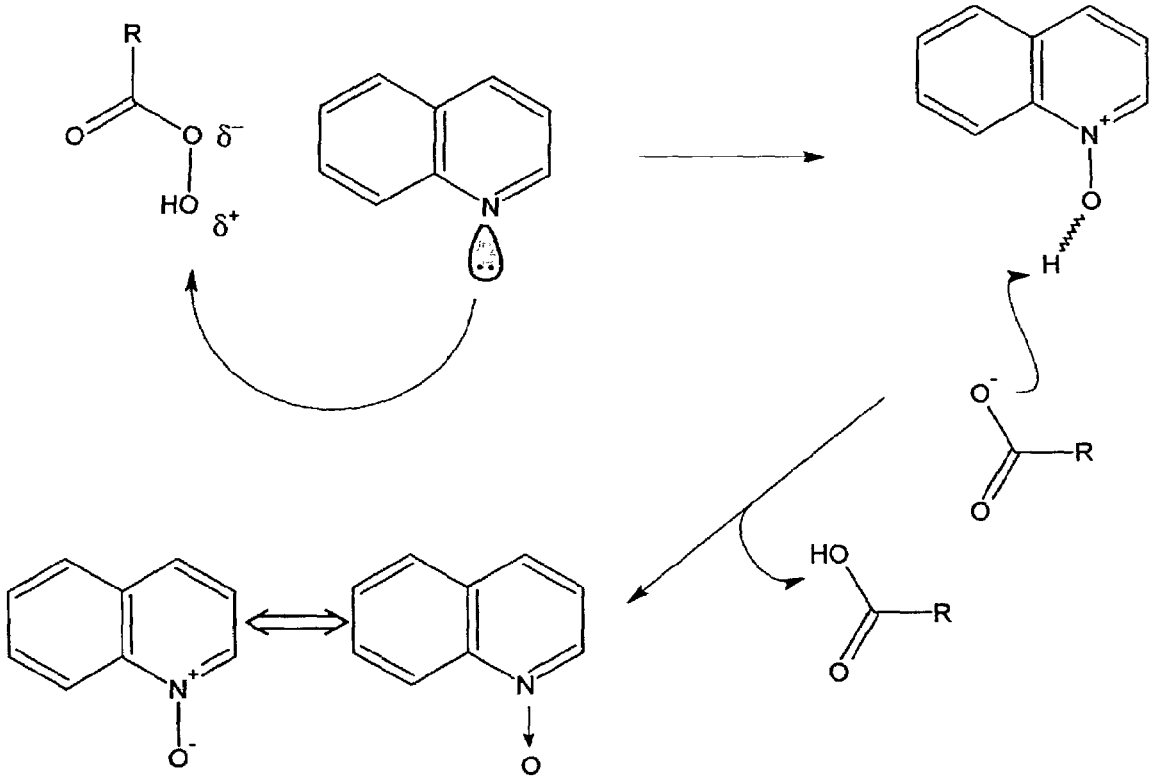
FIG. 2 attached illustrates the oxidation mechanism of a model nitrogen compound such as quinoline so as to generate the equivalent N-oxide and regenerating the organic acid.
FIG. 3 attached illustrates the natural decomposition mechanism of the hydrogen peroxide.
Figure 6:
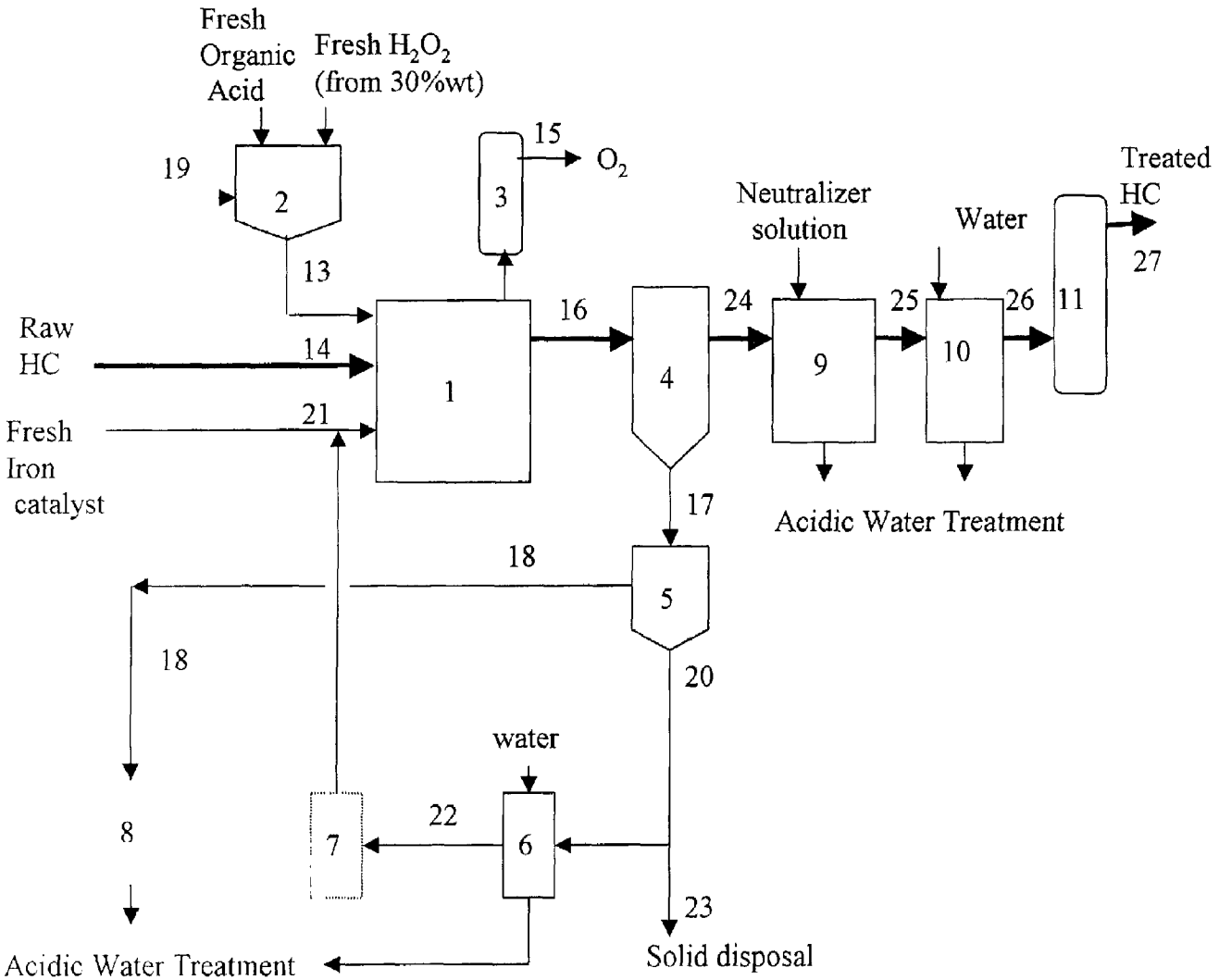
FIG. 6 attached is a proposed flowchart of the inventive process.

The invention is further illustrated by the schematic flowchart of FIG. 6.

Thus, into reactor 1, raw hydrocarbon is introduced via line 14 and fresh limonite, via line 21. Tank 2 contains fresh peroxide solution and organic acid; to tank 2 is alternatively directed via line 19, a recycled portion of waste organic acid aqueous solution. The reaction takes place under reflux by means of condensation system 3, from which a gas stream containing $O_2$ is vented off via line 15. The oxidized mixture is directed via line 16 to decanter 4 where an aqueous slurry phase is decanted and directed to decanter 5 via line 17. The decanted solid, mostly comprised of reusable catalyst, is directed to water washer 6 via line 20 and then directed to an alternative dryer 7 before being recycled to reactor 1, a portion of used solid of line 22 stream being purged off via line 23. The upper organic acid aqueous solution of decanter 5 is directed via line 18 to be disposed though the water treatment system, after being neutralized in 8 if necessary. The upper hydrocarbon phase from decanter 4 is directed via line 24 to block 9 where the oxidized hydrocarbon is neutralized with the aid of an alkaline solution and separated from the waste brine by decantation, the waste brine being sent to disposal. Neutralized hydrocarbon is directed via line 25 to water washer 10, where remaining salts are washed off the hydrocarbon stream, the wasted water being sent to disposal. Washed hydrocarbon is directed to dryer 11 via line 26. Treated hydrocarbon is produced via line 27.

The invention will now be illustrated by the following Examples, which should not be construed as limiting same.

EXAMPLES

The Examples below refer to the treatment being applied to raw naphtha cuts obtained from oil shale retorting.

Example 1

To a 1 liter, three necked, round-bottomed flask provided with a reflux condenser cooled with ethyl alcohol at −16° C. followed by a dry ice trapper of non refluxed hydrocarbon matter carried by non condensable gases, were added 500 ml raw shale oil naphtha having a distillation range of 35° C. to 240° C. and containing 814.6 ppm basic nitrogen, 1,071.9 ppm total Nitrogen and 7,249.7 ppm total Sulfur. Then were added 5 g of limonite ore (45 weight % Fe, from nickel ore mines located in Central Brazil) after being pulverized to lower than 0.177 mm to higher than 0.149 mm (−80 to +100 mesh Tyler) and oven dried for 1 hour at 150° C. The contents were vigorously stirred. The flask was heated to a temperature of 50° C. during 27 minutes. Then the heating was over and the oxidant solution was added.

The previously prepared oxidant solution contained 65 ml $H_2O_2$ 30% w/w and 24 ml formic acid analytical grade. The solution was agitated for 1 minute, until oxygen bubbles were given off.

The so-prepared oxidant solution was added to the contents of the reaction flask for 20 minutes. The flow rate of the oxidant solution was 4.9 mL/min. The reaction was run for an additional 10 minutes, so as to attain 30 minutes total reaction time.

During the reaction the temperature reaches 62° C. during the first 10 minutes, and after 30 minutes is again at 50° C.

After the reaction is completed, the naphtha and aqueous (slurry) phases are separated. The aqueous slurry is discarded.

As a finishing treatment, the naphtha phase (pH=3–4) was neutralized with 200 ml of an aqueous 10% w/w $Na_2SO_3$ solution for 25 minutes under vigorous agitation. The aqueous and organic phases were then separated, and an additional 20 minutes are left for complete decanting of residual visible solid matter. The waste aqueous solution was discarded and the neutralized naphtha (pH=6–7) was collected.

The so neutralized naphtha was washed with 100 mL of demineralized water and the phases were again separated. The so-washed naphtha was then dried and filtered over cotton and sent for analysis.

The yield of the so-obtained upgraded naphtha from this laboratorial batch experiment was 89.4% w/w plus 5–6% w/w attributed to naphtha losses due to evaporation during the bench experimental procedures. It should be pointed out that when operating in larger scale continuous process, it is expected that the said 5–6% w/w losses will not occur or if so, to a much reduced extent.

Experimental analysis of upgraded naphtha indicated 16.8 ppm basic Nitrogen (97.9% removal), 6282.7 ppm total Sulfur (13.1% removal), and total Nitrogen 171.9 ppm (84.0% removal).

Example 2

To a 1 liter, three necked, round-bottomed flask provided with a reflux condenser cooled with ethyl alcohol at −16° C. followed by a dry ice trapper of non refluxed hydrocarbon matter carried by non condensable gases, was added the oxidant solution made up of 40 ml $H_2O_{250}$% w/w and 32 ml formic acid analytical grade. The contents were agitated for 10 minutes. Then was added 500 ml raw shale oil naphtha having a distillation range of 41° C. to 255° C. and containing 813.2 ppm basic nitrogen, 1,900 ppm total Nitrogen, 8,100 ppm total sulfur, 2.37 mole/L conjugated dienes and 26.3% w/w olefins. The mixture was agitated for 2 minutes, and then were added 5 g of limonite ore (45 weight % Fe, from nickel ore mines located in Central Brazil) after being pulverized to lower than 0.105 mm (−150 mesh Tyler) and oven dried for 1 hour at 150° C. Maximum temperature attained 70° C. after 12 minutes reaction. After 35 minutes reaction, the reaction system was externally cooled by known means. The overall reaction time reached 80 minutes. The final temperature was ambient.

After the reaction is completed, the naphtha and aqueous (slurry) phases were separated. The aqueous slurry was discarded.

As a finishing treatment, the naphtha phase (pH=3–4) was neutralized with 200 ml of an aqueous 10% w/w $Na_2CO_3$ solution for 35 minutes under vigorous agitation. The aqueous and organic phases were then separated, and an additional 20 minutes were left for complete decanting of residual visible solid matter. The waste aqueous solution was discarded and the neutralized naphtha (pH=6–7) was collected.

The so-neutralized naphtha was washed with 100 mL of demineralized water and the phases were separated. The so-washed naphtha was recovered by filtering on cotton and sent for analysis.

The yield of the so-obtained upgraded naphtha from this laboratorial batch experiment was 83.95% w/w plus ca. 9% w/w attributed to naphtha losses due to evaporation during the bench experimental procedures. It should be pointed out that when operating in larger scale continuous process, it is expected that the said losses will not occur or if so, to a much reduced extent.

Experimental analysis of upgraded naphtha indicated 4.6 ppm basic Nitrogen (99.4% removal), 7,727 ppm total Sulfur (10.2% removal), total Nitrogen 234 ppm (87.7% removal), conjugated dienes 2.03 mole/L (14.3% removal) and olefins 25.1% w/w (4.56% removal).

Example 3

To a 1 liter, three necked, round-bottomed flask provided with a reflux condenser cooled with ethyl alcohol at −16° C. followed by a dry ice trapper of non refluxed hydrocarbon matter carried by non condensable gases, was added the oxidant solution made up of 40 ml $H_2O_2$ 50% w/w and 32 ml formic acid analytical grade. The contents were agitated for 10 minutes. Then was added 500 ml raw shale oil naphtha having a distillation range of 41° C. to 255° C. and containing 813.2 ppm basic nitrogen, 1,900 ppm total Nitrogen, 8,100 ppm total sulfur, 2.37 mole/L conjugated dienes and 26.3% w/w olefins. The mixture was agitated for 2 minutes, and then were added 3 g of limonite ore (45 weight % Fe, from nickel ore mines located in Central Brazil) after being pulverized to lower than 0.105 mm (−150 mesh Tyler) and oven dried for 1 hour at 150° C. Maximum temperature attained 69.2° C. remaining at this temperature for 15 minutes. After 25 minutes reaction, temperature started to decrease, reaching 46.5° C. after 60 minutes and then the reaction system was externally cooled until ambient temperature.

After the reaction is completed, the naphtha and aqueous (slurry) phases were separated. The aqueous slurry was discarded.

As a finishing treatment, the naphtha phase (pH=3–4) was neutralized with 200 ml of an aqueous 10% w/w $Na_2CO_3$ solution for 35 minutes under vigorous agitation. The aqueous and organic phases were then separated, and an additional 20 minutes were left for complete decanting of residual visible solid matter. The waste aqueous solution was discarded and the neutralized naphtha (pH=6–7) was collected.

The so-neutralized naphtha was washed with 100 mL of demineralized water and the phases were separated. The so-washed naphtha was recovered by filtering on cotton and sent for analysis.

The yield of the so-obtained upgraded naphtha from this laboratorial batch experiment was 85.4% w/w plus ca. 6–7% w/w attributed to naphtha losses due to evaporation during the bench experimental procedures. It should be pointed out that when operating in larger scale continuous process, it is expected that the said losses will not occur or if so, to a much reduced extent.

Experimental analysis of upgraded naphtha indicated 4.5 ppm basic Nitrogen (99.45% removal), 7,090 ppm total Sulfur (12.47% removal), conjugated dienes 1.86 mole/L (21.52% removal) and olefins 22.0% w/w (16.35% removal).

Example 4

To a 1 liter, three necked, round-bottomed flask provided with a reflux condenser cooled with ethyl alcohol at −16° C. followed by a dry ice trapper of non refluxed hydrocarbon matter carried by non condensable gases, was added the oxidant solution made up of 32 ml $H_2O_2$ 60% w/w and 24 ml formic acid analytical grade. The contents were agitated for 10 minutes. Then was added 500 ml raw shale oil naphtha having a distillation range of 41° C. to 255° C. and containing 813.2 ppm basic nitrogen, 1,900 ppm total Nitrogen, 8,100 ppm total sulfur, 2.37 mole/L conjugated dienes and 26.3% w/w olefins. The mixture was agitated for 2 minutes, and then were added 3 g of limonite ore (45 weight % Fe, from nickel ore mines located in Central Brazil) after being pulverized to lower than 0.105 mm (−150 mesh Tyler) and oven dried for 1 hour at 150° C. Maximum temperature attained 71.5° C. after 10 minutes, remaining at this temperature for an additional 20 minutes. Then, temperature started to decrease, reaching 45.2° C. after 60 minutes reaction, and the reaction was externally cooled up to ambient temperature.

After the reaction is completed, the naphtha and aqueous (slurry) phases were separated. The aqueous slurry was discarded.

As a finishing treatment, the naphtha phase (pH=3–4) was neutralized with 200 ml of an aqueous 10% w/w $Na_2CO_3$ solution for 35 minutes under vigorous agitation. The aqueous and organic phases were then separated, and an additional 20 minutes were left for complete decanting of residual visible solid matter. The waste aqueous solution was discarded and the neutralized naphtha (pH=6–7) was collected.

The so-neutralized naphtha was washed with 100 mL of demineralized water and the phases were separated. The so-washed naphtha was recovered by filtering on cotton and sent for analysis.

The yield of the so-obtained upgraded naphtha from this laboratorial batch experiment was 85.9% w/w plus 9–10% w/w attributed to naphtha losses due to evaporation during the bench experimental procedures. It should be pointed out that when operating in larger scale continuous process, it is expected that the said losses will not occur or if so, to a much reduced extent.

Experimental analysis of upgraded naphtha indicated 4.8 ppm basic Nitrogen (99.41% removal), 7,020 ppm total Sulfur (13.3% removal), conjugated dienes 1.84 mole/L (22.36% removal) and olefins 22.6% w/w (14.07% removal).

We claim:

1. A process for the upgrading of raw hydrocarbon streams by oxidation and/or inertization of sulfur, nitrogen, conjugated dienes and other unsaturated compounds from raw hydrocarbon streams rich in heteroatomic polar compounds and/or unsaturated moieties in the presence of a peroxide solution/organic acid couple and a pulverized raw iron oxide catalyst at atmospheric pressure, under equal or higher than ambient temperature, wherein said process comprises the following steps:

a) oxidizing sulfur, nitrogen, conjugated dienes and unsaturated compounds present in said raw hydrocarbon streams by admixing, under agitation, said organic acid and said peroxide, the weight percent of the peroxide solution and organic acid based on raw hydrocarbon being at least 3 and 4 respectively, then adding said raw hydrocarbon stream containing sulfur, nitrogen, conjugated dienes and unsaturated compounds and then the raw iron oxide catalyst, pulverized and dried to a granulometry lower than 0.177 mm, in an amount of from 0.01 to 5.0 weight % based on the weight of raw hydrocarbon, at a pH between 1.0 and 6.0, the reaction being carried out under reflux of vaporized hydrocarbon, for the period of time required to effect the extractive oxidation and obtaining a hydrocarbon stream wherefrom the sulfur, nitrogen, conjugated dienes and unsaturated compounds have been partially oxidized and simultaneously extracted by the aqueous oxidant slurry, yielding a lower aqueous slurry phase and an upper oxidized hydrocarbon phase;

b) after the end of said extractive oxidation, separating the upper hydrocarbon phase, neutralizing and water washing same, filtering and drying;

c) recovering said treated, odorless, clear yellowish and stable hydrocarbon phase wherefrom the total nitrogen compounds have been removed up to 90% by weight, basic nitrogen compounds have been removed up to 99.7% by weight, conjugated diene compounds have been removed up to 22% by weight, and sulfur compounds have been removed up to 13% by weight, followed by olefin removal ranging from 4% to 16 weight %, all percentages being based on the original feedstock content.

2. A process according to claim 1, wherein alternatively, the pulverized and dried raw iron oxide catalyst is added in the first place to the hydrocarbon stream containing sulfur, nitrogen and conjugated diene and other unsaturated compounds.

3. A process according to claim 1, wherein the raw hydrocarbon feed is any raw light and middle distillate.

4. A process according to claim 1, wherein the raw hydrocarbon feed is raw naphtha of boiling range between 30 and 300° C.

5. A process according to claim 4, wherein the raw naphtha is obtained from oil shale retorting.

6. A process according to claim 1, wherein the iron oxide catalyst comprises iron oxyhydroxide of formula FeOOH, hydrated iron oxyhydroxide of formula $FeOOH._nH_2O$ and crystalline forms such as α-FeOOH (Goethite), γ-FeOOH (Lepidocrocite), β-FeOOH (Akaganeite), and δ'-FeOOH (Ferroxyhite).

7. A process according to claim 6, wherein the amount of iron oxide catalyst is of from 0.5 to 3.0 weight % based on the weight of raw hydrocarbon submitted to the process.

8. A process according to claim 6, wherein the granulometry of the iron oxide catalyst is 0.105 mm (150 mesh Tyler) or less.

9. A process according to claim 6, wherein the granulometry of the iron oxide catalyst is 0.149 mm (100 mesh Tyler).

10. A process according to claim 1, wherein the peroxide is added as such or in solution.

11. A process according to claim 10, wherein the peroxide is hydrogen peroxide at a concentration of at least 30 weight %.

12. A process according to claim 11, wherein the hydrogen peroxide concentration is 50 weight %.

13. A process according to claim 11, wherein the hydrogen peroxide concentration is 60 weight %.

14. A process according to claim 1, wherein the extractive oxidation of heteroatomic polar compounds from the said raw hydrocarbon streams comprises said oxidized compounds, as a result of the strong affinity of same for the aqueous slurry phase, being extracted into said phase by the aqueous oxidant itself.

15. A process according to claim 1, wherein the organic acid is formic acid.

16. A process according to claim 1, wherein the organic acid is acetic acid.

17. A process according to claim 1, wherein the weight percent of the peroxide solution and organic acid based on the raw hydrocarbon is 6 to 15 and 8 to 20, respectively.

18. A process according to claim 1, wherein the peroxide/organic acid molar ratio is in the range of from 0.5 to 1.2.

19. A process according to claim 18, wherein said molar ratio is in the range of from 0.9 to 1.1.

20. A process according to claim 19, wherein said molar ratio is in the range of from 0.95 to 1.

21. A process according to claim 1, wherein the waste water and waste alkaline neutralizing solutions from the neutralized and washed hydrocarbon are completely purged.

22. A process according to claim 21, wherein the waste water and waste alkaline neutralizing solutions from the neutralized and washed hydrocarbon are recycled after being partially purged.

23. A process according to claim 1, wherein the aqueous slurry phase, comprising the spent oxidant solution and iron oxide catalyst, is decanted to separate the solid catalyst phase.

24. A process according to claim 23, wherein the solid catalyst phase is disposed off.

25. A process according to claim 23, wherein the solid catalyst phase is reused after being washed and dried.

26. A process according to claim 25, wherein a portion of the solid reused catalyst is purged and made up with fresh limonite in order to replace spent catalyst.

* * * * *